United States Patent [19]

Regalbuto et al.

[11] Patent Number: 4,753,170

[45] Date of Patent: Jun. 28, 1988

[54] POLYGONAL DETONATING CORD AND METHOD OF CHARGE INITIATION

[75] Inventors: John A. Regalbuto; Jack E. Dines, both of Fort Worth, Tex.

[73] Assignee: Jet Research Center, Arlington, Tex.

[21] Appl. No.: 705,154

[22] Filed: Feb. 25, 1985

Related U.S. Application Data

[62] Division of Ser. No. 507,253, Jun. 23, 1988.

[51] Int. Cl.[4] ..... F42D 1/00; E21B 43/117

[52] U.S. Cl. ..... 102/305; 89/1.15; 102/200; 102/275.8; 102/701; 175/4.6

[58] Field of Search ..... 102/200, 202, 204, 275.1, 102/275.5, 275.8, 275.9, 305, 306, 310, 311–313, 319, 475, 476, 470, 701; 86/1 R; 89/1.15; 175/4.6; 166/55, 63

[56] References Cited

U.S. PATENT DOCUMENTS

| | | | |
|---|---|---|---|
| 1,923,761 | 8/1933 | Snelling et al. | 86/1 R |
| 2,418,769 | 4/1947 | Hebard | 86/1 R |
| 2,873,676 | 2/1959 | Caldwell | 102/310 X |
| 2,877,708 | 3/1959 | Rey | 102/275.8 |
| 2,968,243 | 1/1961 | Turechek | 102/310 X |
| 3,019,731 | 2/1962 | Edwards et al. | 102/310 |
| 3,241,489 | 3/1966 | Andrew et al. | 102/275.5 |
| 3,320,883 | 5/1967 | Welsh | 102/275.8 |
| 3,374,737 | 3/1968 | Pike | 102/275.5 |
| 3,565,188 | 2/1971 | Hakala | 175/4.6 |
| 3,782,284 | 1/1974 | Gibb et al. | 102/275.8 |
| 4,071,096 | 1/1978 | Dines | 175/4.6 |
| 4,080,902 | 3/1978 | Goddard et al. | 102/275.8 |
| 4,140,188 | 2/1979 | Vann | 166/63 |
| 4,170,178 | 10/1979 | Diewald | 102/275.9 |
| 4,239,003 | 12/1980 | Savitt | 102/275.5 X |
| 4,371,044 | 2/1983 | Willig et al. | 175/4.6 |
| 4,478,294 | 10/1984 | Sumner | 102/200 X |

*Primary Examiner*—David H. Brown

*Attorney, Agent, or Firm*—James R. Duzan

[57] ABSTRACT

The present invention comprises a detonating cord of polygonal cross section having three or more substantially flat sides of substantially equal length and substantially equal included angles between each of the sides.

3 Claims, 3 Drawing Sheets

POLYGONAL DETONATING CORD AND METHOD OF CHARGE INITIATION

This application is a division, of application Ser. No. 507,253, filed June 23, 1983.

BACKGROUND OF THE INVENTION

Shaped charges are commonly used to perforate casing in an oil or gas well, and a plurality of such charges are generally run into the well bore in a tubular perforating gun at the end of a wireline or on tubing. The gun holds each charge in a desired outward-pointing orientation and at a particular vertical level. As each charge is detonated, the explosive jet penetrates the casing, the cement sheath surrounding the casing, and extends into the producing formation, ideally forming a tunnel therein to provide more surface area and an enlarged flow path for the oil or gas from the formation.

In recent years, it has been recognized that certain producing formations benefit from so-called "high density" perforating, which may be defined as making more than twelve (12) perforations per foot of well interval. To effect such high perforation densities, shaped charges have been used in clusters of two, three, four and even five charges at 180°, 120°, 90° and 72° circumferential intervals, respectively. The clusters of shaped charges are mounted with the detonating ends of the charges pointed on radial lines toward the center of the perforating gun housing, and in close proximity thereto, and the mouths of the charges facing outward. A detonating cord extends down the centerline of the perforating gun, and is contacted about its periphery by booster charges at the detonating ends of the shaped charges. When the detonating cord is ignited by the firing head of the perforating gun, it detonates and in turn sets off the booster chargcs in the shaped charges, which initiate the shaped charge explosions.

An example of a prior art high-density perforating system is disclosed in U.S. Pat. No. 4,140,188, issued on Feb. 20, 1979 to Roy R. Vann. While such a high density system may be advantageous, it suffers from a serious deficiency in that the detonating cord may not effect sufficient energy transfer to the booster charges of all the shaped charges in a cluster on the same radial plane. The aforesaid deficiency is inherent in the detonating cord of the prior art, due to its cross-sectional configuration, which is generally circular, so that the detonating cord detonation results in a cylindrically expanding energy wave, which experiences an energy density decrease between the cord and the booster charges, proportional to the square of the distance travelled by the energy wave. Moreover, the dense clustering of charges about a central detonating cord severely limits the standoff distance of each charge from the wall of the gun housing. As adequate standoff is critical for maximum penetration of the shaped charge jet, the use of a cylindrical prior art cord having sufficient explosive material therein can impair jet efficiency by reducing standoff.

Prior art detonating tapes, fuses, or cords having one or two flat sides are known, but such tapes, fuses, or cords are not suitable for detonating a shaped charge due to their fragility and lack of sufficient energy propagation. Polygonal detonating cords of irregular cross-section are also known, as are cords having combinations of arcuate and flat sides, but these prior art cords are configured to propagate energy in a single direction.

SUMMARY OF THE INVENTION

The present invention comprises a detonating cord of polygonal cross section having substantially flat sides of substantially equal length and substantially equal included angles between each of the sides. The detonating cord of the present invention provides a plurality of flat sides which each propagate a plane energy wave of substantially equal magnitude, having a substantially linear energy density decrease with respect to the distance travelled by the energy wave, as measured in close proximity to the cord. That is to say, the energy loss of a plane wave may be related to the distance travelled by the wave, rather than to the square of the distance travelled, as in circular cross-section cords. Stated another way, the detonating cord of the present invention employs cord geometry as a factor to enhance the direction and magnitude of energy transmission to a particular target.

Thus, the detonating cord of the present invention provides the surprising and unobvious results of more reliable detonation of hard to initiate explosives, quicker pickup at the cord detonation by the shaped charge booster charge, and the ability to use a cord of lesser explosive content for a required booster charge initiation energy, which engenders the possibility of increasing the standoff distance of the shaped charges in the gun.

BRIEF DESCRIPTION OF THE DRAWINGS

The structure and operation of the detonating cord of the present invention may be more fully understood by one of ordinary skill in the art by referring to the following detailed description of the preferred embodiments thereof, taken in conjunction with the accompanying drawings, wherein:

FIG. 5 is a cross-section of an octagonal detonating cord of the present invention.

FIG. 6 is a cross-section of a high density perforating gun with the detonating cord of FIG. 5 (enlarged for clarity) in place.

DETAILED DESCRIPTION OF THE PREFERRED EMBODIMENTS OF THE PRESENT INVENTION

Figure 1:
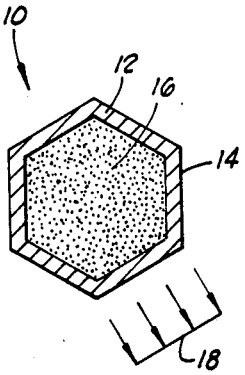
FIG. 1 is a cross-section of a hexagonal detonating cord of the present invention.

FIG. 1 discloses a first preferred embodiment of the present invention. Detonating cord 10 is shown in cross section, sheath 12 of substantially uniform thickness being of lead, copper, aluminum, alloys thereof or other suitable material known in the art. Detonator explosive 16 inside of sheath 12 may be any of a number of known explosive compounds, such as cyclotrimethylenetrinitramine, hexahydro-1,3,5-trinitro-5-triazine, cyclonite, hexogen, T4, commonly referred to as RDX; octogen, known as HMX; or 2,2',4,4',6,6'-hexanitrostilbene, known as HNS. If detonating cord 10 is to be employed in a high temperature (above 500° F.) well bore, the explosive compound 2,6-bis(Picrylamino)-3,5,dinitropyridine, known as PYX, may be employed with a copper or aluminum sheath, lead being unsuitable for such temperatures. The foregoing examples of explosive compounds are not intended to so limit the materials of choice, but are merely illustrative. As may readily be observed in FIG. 1, sheath 12 possesses six substantially flat sides 14 of substantially equal length having substantially equal angles therebetween. Upon detonation of hexagonal cord 10 the explosive energy of explosive compound 16 is directed substantially equally in six specific directions, unlike a circular detonating cord which dissipates its energy over a 360° circumference in an arcuate wave. This surprising and unexpected phenomenon is illustrated by the graphically portrayed plane energy wave 18 in FIG. 1.

Figure 2:
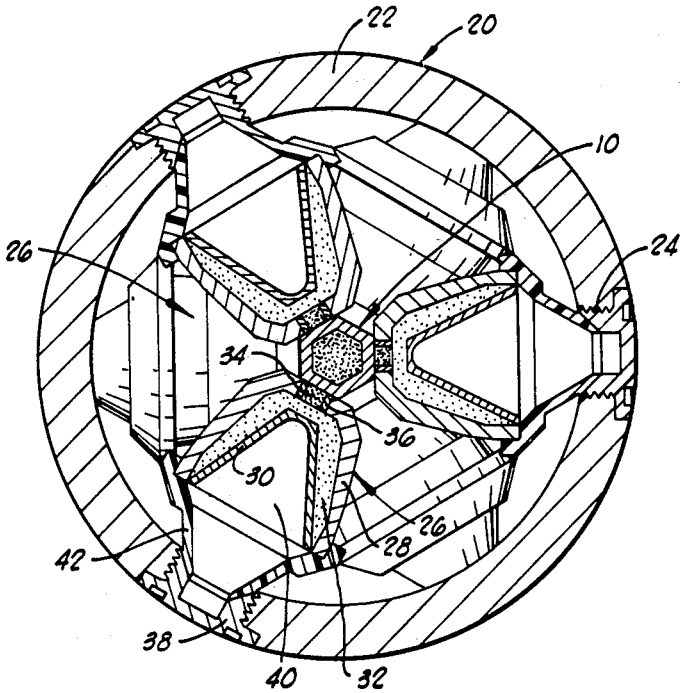
FIG. 2 is a cross-section of a high density perforating gun shown with the detonating cord of FIG. 1 (enlarged for clarity) in place.

Hexagonal cord 10 may be employed as shown schematically in FIG. 2. Perforating gun 20, comprising a circular housing 22 with ports 24 corresponding to shaped charge placement therein, is loaded with a cluster of three shaped charges 26 (shown in section) each of which includes metal casing 28 and powder metal liner 30, having shaped charge explosive 32 disposed therebetween. At the rear end of each charge, which is positioned toward the center of gun 20, a booster charge comprising an explosive 34 such as RDX, HMX, HNS or PYX in a short metal jacket 36, abuts hexagonal detonating cord 10 (shown enlarged for clarity) which is disposed on-the centerline of gun 20. Port plug 38 closes the mouth of each port 24 and charge holder 42 positions and maintains the mouth 40 of each shaped charge 26 centered on its respective port 24. Of course, there is other support structure to maintain the shaped charges 26 in position, but such is well known in the art and has been removed so as to better show a second, lower cluster of charges 26 below the first, which is shown in section. The second, lower cluster also comprises three charges 26 abutting cord 10, but the second cluster is rotated 60° from the top cluster.

The top cluster of charges is ignited from three sides 14 of detonating cord 10, while the lower cluster is ignited from the three sides 14 spaced 60° out of phase from the first three sides 14. This pattern of charge clusters, each rotated 60° out of phase with the clusters above and below it, may be continued throughout the length of perforating gun 20.

While detonating cord 10 has been shown enlarged for purposes of clarity, it should be realized that its flat sides 14 reduce the amount of explosive 16 required, due to the unexpectedly enhanced explosive power transmission of the plane energy waves 18, and, as a consequence, shaped charges 26 may be placed closer to the centerline of gun 20, increasing the standoff (distance) of the shaped charges 26 from the wall of the well bore casing and enhancing the quality of the shaped charge jet. It is believed that the enhanced explosive power transmission characteristics of detonating cord 10 and other detonating cords of the configuration of the present invention are due to the fact that all of the energy from the flat detonating cord side encounters the explosive of the booster charge substantially simultaneously, whereas with the curved exterior of a circular or other arcuate cross section cord, the energy from the tangent point closest to the booster charge will strike first, followed by the rest as the curvature of the cord side increases the distance from the flat face of the booster charge. In addition, it should be pointed out that an entire energy wave from a side of the detonating cord of the present invention is propagated normal to the flat face of the booster charge, striking it directly and focusing the energy more directly than in an arcuate cross section cord.

Figure 3:
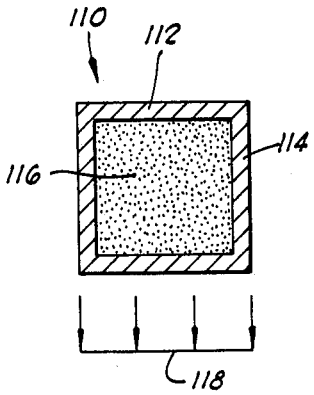
FIG. 3 is a cross-section of a square detonating cord of the present invention.
Figure 4:
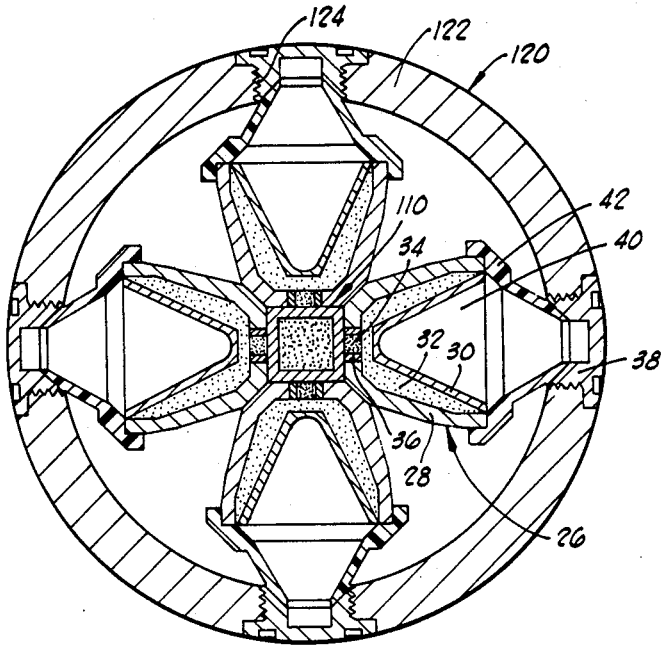
FIG. 4 is a cross-section of a high density perforating gun with the detonating cord of FIG. 3 (enlarged for clarity) in place.

A second preferred embodiment of the present invention is depicted in cross-section in FIG. 3. Square detonating cord 110 comprises an outer sheath 112 having four substantially equal and substantially flat sides 114, with substantially equal angles therebetween. Sheath 112 and explosive 116 may be of any of the suitable materials previously delineated with respect to detonating cord 10. Detonating cord 110 produces, upon detonation, four substantially equal plane energy waves, one of which is graphically illustrated at 118. Detonating cord 110 is illustrated in FIG. 4 in place in perforating gun 120, comprising tubular housing 122 having ports 124 therein at 90° intervals. Four shaped charges 26, substantially identical to and having the same component parts as charges 26 in FIG. 2, are arranged in a cluster with their rear ends abutting cord 110, and their mouths facing and aligned with ports 124. Upon ignition of detonating cord 110 by the gun firing mechanism, cord 110 produces four substantially equal substantially plane energy waves 118 which in turn ignite booster charges 34. As with the detonating cord 10 shown in FIG. 2, cord 110 is enlarged in size for purposes of clarity, but in reality it may be of smaller size than a circular cross-section cord due to its unexpectedly enhanced energy transmission characteristics.

FIG. 5 depicts a third preferred embodiment, octagonal detonating cord 210 comprising eight substantially equal substantially flat sides having substantially equal angles therebetween. Detonating cord 210 comprises sheath 212 including eight substantially flat substantially equal sides 214, which enclose explosive 216. Sheath 212 and explosive 216 may comprise any of the suitable materials heretofore disclosed, as well as others. Upon ignition, cord 210 produces eight substantially plane and substantially equal energy waves 218. FIG. 6 illustrates cord 210 in place in a perforating gun 220 comprising tubular housing 222 having ports 224 in sets of four at 90° intervals, each set of four apertures being rotated 45° out of phase with the one above and below it. Shaped charges 26, substantially identical to those previously described, are clustered in sets of four, oriented so as to have their booster charges abutting cord 210 at the centerline of housing 222, and their mouths facing and aligned with ports 224. As can easily be seen, the upper cluster of shaped charges 26 is ignited by plane energy waves from four of the eight faces 214 of cord 210, with the lower cluster being ignited by plane energy waves from the other four, interspersed faces 214. The performance of cord 210 is enhanced, as with cords 10 and 110, by its cross-sectional configuration.

Figure 8:
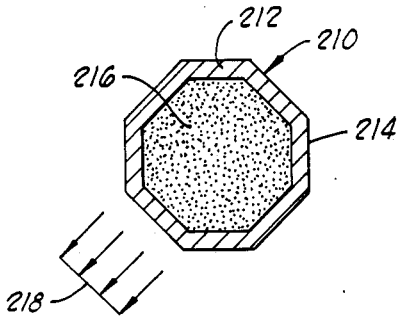
FIG. 8 is a cross-section of a high density perforating gun with the detonating cord of FIG. 7 (enlarged for clarity) in place.
Figure 9:
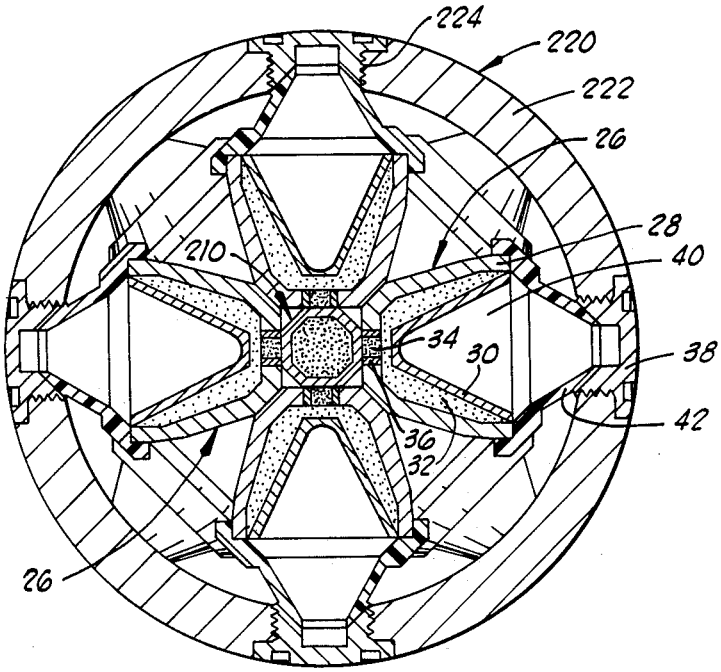
Figure 7:
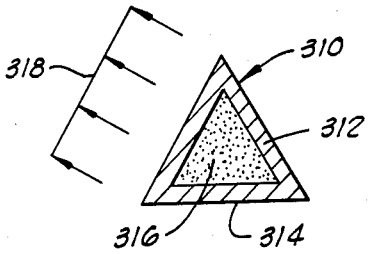
FIG. 7 is a cross-section of a triangular detonating cord of the present invention.
Figure 8:
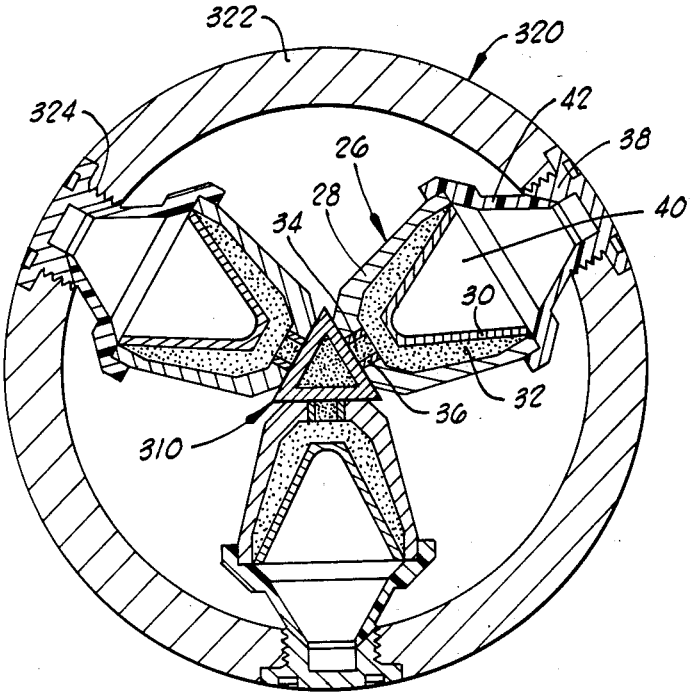

FIG. 7 and FIG. 8 depict a triangular detonating cord 310 having three substantially flat substantially equal sides having substantially equal angles therebetween. Sheath 312 having sides 314 encloses explosive 316. In FIG. 8, perforating gun 320 comprising tubular housing 322 with three ports 324 at 120° intervals therethrough, and shaped charges 26 disposed with their mouths aligned with apertures 324 and their booster charges abutting cord 310. Upon ignition of cord 310, three substantially equal substantially plane energy waves 318 ignite the booster charges, thus substantially simultaneously detonating shaped charges 26 in the surprising and unexpectedly reliable manner previously mentioned with respect to the other preferred embodiments. In gun 320, all ports 324 in housing 322 are substantially vertically aligned.

It should be noted that triangular cord 310 might be employed in gun 20, by twisting cord 310 between levels of clustered charges, in lieu of hexagonal cord 10. Such a substitution might also be made with square cord 110 in gun 220, by twisting cord 110 between levels in lieu of using octagonal cord 210. This sort of arrangement has the advantage of directing more energy from a larger flat cord side than would be pcssible from a similar-sized cord having more flat sides. Alternatively, the detonating cord could be made of smaller cross-sectional area due to the enhanced energy transmission characteristics of the flat sides, so as to further increase the standoff of the charges.

Detonating cords 10, 110, 210, and 310 and other polygonal detonating cords having substantially equal, substantially flat sides with substantially equal included angles may be formed by drawing a circular cross-section cord through a die, or by cladding a polygonal cross-section explosive with a sheath. Thus, five sided, seven sided, ten sided or other polygonal cord configurations may be fabricated, to suit the clustering of charges employed in the perforating gun of preference.

Polygonal substantially flat sided detonating cords as illustrated in the preferred embodiments have surprisingly been found to provide more reliable detonation of hard to initiate explosives such as HNS or PYX, particularly at higher temperatures, quicker pickup of cord detonation and consequent shaped charge detonation by the booster charges employed therein. These phenomena, a result of the unexpected energy transmission enhancement of the claimed invention, allows the use of lesser amounts of explosive material in a detonating cord, and hence greater safety, as well as an increase in standoff distance for the shaped charges employed therewith.

It is apparent that a novel and unobvious detonating cord has been invented, with a cross-sectional configuration which produces surprising levels of energy transfer in comparison to the prior art. Additions, modifications or deletions may be made to the preferred embodiments disclosed herein without departing from the spirit and scope of the claimed invention. By way of example, and not limitation: other explosive and sheath materials (both metallic and non-metallic) may be substituted for those disclosed in the description of the preferred embodiments; explosive materials of the polygonal configurations disclosed may be utilized without a sheath if their structural integrity so permits, or if a central wire cable, or other supporting structure is employed to support a surrounding explosive.

We claim:

1. A method of initiating clustered shaped charges, comprising:

providing a plurality of shaped charges, each of said charges including a booster charge at one end thereof and a mouth at the other end thereof;

disposing said plurality of shaped charges in at least one cluster about a center point, with said booster charges of said shaped charges pointed toward said center point of said at least one cluster and said mouths of said shaped charges are pointed substantially radially outward;

disposing a detonating cord through said center point of said at least one cluster proximate said booster charges;

igniting said detonating cord; and directing the explosive energy arising from the ignition in substantially equal plane energy waves against each of said booster charges.

2. The method of claim 1, further comprising disposing said plurality of charges in a plurality of clusters, disposing said plurality of clusters one above the other, and running said detonating cord through the center points of said clusters.

3. The method of claim 2, further including rotating each of said clusters with respect to adjacent clusters so that said mouths of said shaped charges of each cluster are pointed radially outward between those of said adjacent clusters.

* * * * *